US009532146B2

(12) United States Patent
Kalluri et al.

(10) Patent No.: US 9,532,146 B2
(45) Date of Patent: Dec. 27, 2016

(54) METHOD AND APPARATUS FOR TESTING BINAURAL HEARING AID FUNCTION

(75) Inventors: Sridhar Kalluri, El Cerrito, CA (US); Brent Edwards, San Francisco, CA (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 896 days.

(21) Appl. No.: 12/645,040

(22) Filed: Dec. 22, 2009

(65) Prior Publication Data

US 2011/0150232 A1 Jun. 23, 2011

(51) Int. Cl.
*H04R 29/00* (2006.01)
*H04R 25/00* (2006.01)

(52) U.S. Cl.
CPC ..... *H04R 25/30* (2013.01); *H04R 25/552* (2013.01); *H04R 25/505* (2013.01)

(58) Field of Classification Search
CPC ..... H04R 25/552; H04R 25/30; H04R 25/70; H04R 25/505; H04R 25/305; A61B 5/121
USPC ..... 381/60, 23.1, 314, 315, 316, 312, 58; 600/559; 455/41.3, 41.2; 73/585
See application file for complete search history.

(56) References Cited

U.S. PATENT DOCUMENTS 6,118,877 A * 9/2000 Lindemann et al. ..... 381/60
6,330,339 B1 * 12/2001 Ishige et al. ..... 381/312
6,816,599 B2 * 11/2004 Thiede et al. ..... 381/314
7,561,707 B2 * 7/2009 Kornagel ..... 381/310
7,929,711 B2 * 4/2011 Burleigh et al. ..... 381/60
2006/0093172 A1 * 5/2006 Ludvigsen et al. ..... 381/315
2007/0133832 A1 * 6/2007 DiGiovanni et al. ..... 381/320
2007/0140506 A1 * 6/2007 Roeck et al. ..... 381/77
2007/0269065 A1 * 11/2007 Kilsgaard ..... 381/315
2008/0008341 A1 * 1/2008 Edwards ..... 381/315
2008/0031480 A1 * 2/2008 Barthel et al. ..... 381/316
2008/0194984 A1 * 8/2008 Keefe ..... 600/559

OTHER PUBLICATIONS

Santurette et al., "Binaural pitch perception in normal-hearing and hearing impaired listeners", Hearing Research, vol. 223, Jan. 2007, pp. 29-47.*

(Continued)

*Primary Examiner* — Vivian Chin
*Assistant Examiner* — Con P Tran
(74) *Attorney, Agent, or Firm* — Schwegman Lundberg & Woessner, P.A.

(57) ABSTRACT

Disclosed herein, among other things, are methods and apparatus for identifying one or more defective hearing aids. The present system provides a dichotic sound to the wearer that can be used to sense whether the aids are properly operating. Different types of dichotic sounds can be presented within the scope of the present subject matter. In various applications a Huggins pitch, a binaural edge pitch, a binaural coherence edge pitch, a Fourcin pitch or a dichotic repetition pitch is used for the dichotic sound. The pitch may be a pure-tone or complex-tone pitch. Various pure-tone frequencies and complex-tone fundamental frequencies may be used and may be customized for a particular application. In various applications, a dichotic sound is formed using left and right sounds each of which includes a noise and a desired signal component. The present system can be realized in a variety of implementations.

32 Claims, 3 Drawing Sheets

(56) References Cited

OTHER PUBLICATIONS

Poon, Becky Bikkei, "Sound localization and interaural time sensitivity with bilateral cochlear implants"—2006—dspace.mit.edu.*
Bilsen, F. A, "Pitch of noise signals: evidence for a "central spectrum"."., J Acoust Soc Am., 61(1), (Jan. 1977), 150-61.
Cramer, Elliot C, et al., "Creation of Pitch through Binaural Interaction", Journal of the Acoustical Society of America, 30(5), (May 1958), 413-417.
Culling, J. F, et al., "Dichotic pitches as illusions of binaural unmasking. II. The Fourcin pitch and the dichotic repetition pitch.", J Acoust Soc Am., 103(6), (Jun. 1998), 3527-39.
Hartmann, William M, et al., "Binaural models and the strength of dichotic pitches", Journal of the Acoustical Society of America, 114(6), (Dec. 2003), 3317-3326.

* cited by examiner

METHOD AND APPARATUS FOR TESTING BINAURAL HEARING AID FUNCTION

FIELD OF THE INVENTION

The present subject matter relates generally to testing the operation of hearing aids, and in particular to method and apparatus for testing binaural hearing aid function.

BACKGROUND

Wearers of hearing aids undergo a process called "fitting" to adjust the hearing aids to their particular hearing and use. After the hearing aids are in use, it can be difficult for a wearer of them to determine whether they are functioning properly. Hearing-impaired (HI) listeners fitted with two hearing aids often do not realize when one of their devices is no longer functioning. Device failure due to dead batteries or due to failure of electro-mechanical components can go undetected for hours and occasionally for days. The failure to detect failure of one device is in part due to lack of experience with hearing-aid wear, but it is probably also due to the relatively minor benefit provided by the second hearing aid in typical quiet environments that are sought and experienced by HI listeners. The consequence of not detecting the failure of one of the aids is that the user may experience difficulty functioning in complex environments where the bilateral fitting truly provides crucial benefits. Listeners may suffer this compromised experience for an indeterminate period of time before the failure is identified.

Thus, there is a need in the art for a system for improved determination of hearing aid failures. Such a system should be easy for the wearer to use and should prevent inconvenient and unnecessary trips to the dispenser or audiologist that fitted the hearing aids. The system should allow for inexpensive and convenient implementation for hearing aid wearers.

SUMMARY

Disclosed herein, among other things, are methods and apparatus for identifying one or more defective hearing aids. The present system provides a dichotic sound to the wearer that can be used to sense whether the aids are properly operating. Different types of dichotic sounds can be presented within the scope of the present subject matter. In various applications a Huggins pitch, a binaural edge pitch, a binaural coherence edge pitch, a Fourcin pitch or a dichotic repetition pitch is used for the dichotic sound. The pitch may be a pure-tone or complex-tone pitch. Various pure-tone frequencies and complex-tone fundamental frequencies may be used and may be customized for a particular application. In various applications, a dichotic sound is formed using left and right sounds each of which includes a noise and a desired signal component. The inter-aural phase of the noise signals and the inter-aural phase of the desired signals are different to enhance detection of the desired signal by a wearer with proper binaural hearing. In various applications, a dichotic sound is formed by repeated playing of a sound having a progression of interaural time differences (ITDs) that give rise to progressively changed lateralization. Such sounds include, but are not limited to pure tones, complex tones, sequences of pure or complex tones to form a melody, a piece of music, speech, or combinations thereof. Some examples are provided with wireless communications that support ear-to-ear communications. Various types of communications modes and coordination of processes operating on the hearing aids are provided. The present system can be realized in a variety of implementations on hearing aids with or without remote processors.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
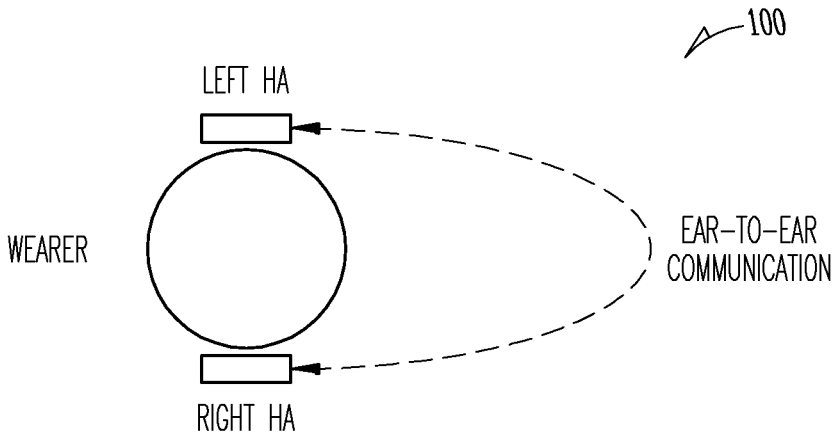
FIG. 1 shows an example of a block diagram of a system for identifying hearing aid failures using an ear-to-ear coordination of sound generation according to one embodiment of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter of the invention relates generally to method and apparatus for improved determination of hearing aid failures by the generation of sounds that a wearer can use to identify if the binaural operation of the worn hearing aids has failed. The present subject matter uses special signal processing in the wearer's hearing aids to play sounds to the wearer that can signal a defective hearing aid. The binaural processing performed by the wearer in view of these special sounds will signal to the wearer if there is a failure of a bilateral hearing-aid fitting. The present subject matter includes systems providing the listener with sounds and/or sound environments such that the wearer will experience auditory percepts arising from binaural interaction in the wearer's brain. In various embodiments, the present subject matter uses one of at least three different related classes of binaural perceptual phenomena including, but not limited to dichotic pitch, binaural signal detection, and sound lateralization.

Dichotic pitch is an emergent property of the binaural system in that it cannot be heard monaurally or through a compromised binaural system. The basic phenomenon manifests as a tonal pitch heard embedded in noise when two noises, differing in very particular ways, are fed separately to the two ears. Heard monaurally or with the noise at one ear much louder than the noise at the other ear, the percept is that of a spatially diffuse noise. In listeners capable of hearing dichotic pitches, proper presentation of the dichotic pitch and then detection of such a pitch provides a simple yes/no indicator of a functioning binaural hearing experience.

Detection of a signal in the presence of noise is greatly improved if the signal and the noise have different binaural characteristics. For example, when the noise is identical in both ears and a tonal signal is 180-deg out of phase in one ear with respect to the other ear, the signal is up to 15-dB more detectable compared to when both signal and noise have the same binaural properties or when they are heard monaurally. In listeners having such a binaural signal detection advantage, perception of a signal buried in noise can serve as an indicator of a functioning binaural system.

Inter-aural time difference (ITD) and inter-aural level difference (ILD) determine to which side from the center of the head a signal is heard. Changes in ITD and ILD determine the degree of lateralization of the signal. For several signals differing in ITD, a listener will perceive differences in lateralization if she has a functioning binaural system. Heard monaurally, all signals will be heard from the same location to the side of the head.

There are several ways of generating dichotic pitches. In one embodiment, a particular type of dichotic pitch, called the Huggins pitch, is used. The original paper describing the Huggins pitch and the phenomenon is: Cramer, E. M. and Huggins, W. H. (1958) "Creation of a pitch through binaural interaction", Journal of the Acoustical Society of America, Vol. 30, Pages 413-417, which is hereby incorporated by reference in its entirety. The Huggins pitch percept of a tone embedded in background noise results when noises presented to the two ears are identical, except for a 180-deg phase shift in a narrow frequency band. The tonal percept arises in the center of this phase-shift band.

The Huggins pitch results from the brain's processing of the correlation between the fine structures of the waveforms at the two ears. Because the auditory nerve encodes fine structure with good fidelity only below approximately 1600 Hz, the Huggins pitch exists only below this frequency limit.

The frequency of the pure tone Huggins pitch is chosen based on constraints set by the characteristics of the patient and the patient's hearing-aid fitting on the one hand and the need to elicit a salient pitch percept on the other hand. One constraint is set by Huggins pitch being strong below 800 Hz, weak above 1200 Hz, and non-existent above 1600 Hz. Another constraint is set by the need to be above the cutoff frequency due to venting or open fittings that prevent the hearing-aid receiver from generating low-frequency sounds in the ear canal. An adherence to the constraint of being above the cutoff frequency set by venting is a part of this invention. It ensures that the dichotic-pitch detection is evaluating aid-borne binaural transmission of stimuli.

As for specific choices for the frequency of a pure-tone Huggins pitch, 900 Hz is a good compromise for generic patients having some venting in their hearing aids, but a lower frequency down to 500 Hz (which gives the strongest Huggins pitch) is preferred for patients having little or no venting in their hearing aids.

Another strategy is to use a complex-tone Huggins pitch, by simultaneously eliciting pure-tone Huggins pitches at multiple frequencies that are integer multiples of a common fundamental frequency. This elicits a strong complex-tone pitch at the fundamental frequency, even if there is no pure-tone pitch at this frequency. The best choice for fundamental frequency and overtone numbers in the generic patient are a range between 250-Hz and 300-Hz for the former and the second to fifth multiples of the fundamental frequency for the latter. These choices exploit the existence of a complex-tone pitch at the fundamental frequency despite the absence of a pure-tone component at the fundamental frequency. They also exploit the dominance of the second, third, fourth, and fifth components in determining the pitch of a harmonic complex tone.

Yet another strategy is to use temporal sequences of pure-tone or complex-tone Huggins pitches that elicit familiar melodies.

There are several other ways of creating a pitch sensation through binaural interaction. These may evoke a weaker pitch than the Huggins pitch. Some examples are the approaches provided for generating dichotic pitches in: F. A. Bilsen (1977) "Pitch of noise signals: Evidence for a central spectrum", Journal of the Acoustical Society of America, Vol. 61, Pages 150-161; J. F. Culling, D. H. Marshall, and A. Q. Summerfield (1998) "Dichotic pitches as illusions of binaural Unmasking. II. The Fourcin pitch and the dichotic repetition pitch", Journal of the Acosutical Society of America, Vol. 103, Pages 3527-3539; and W. M. Hartmann and P. X. Zhang (2003) "Binaural models and the strength of dichotic pitches", Journal of the Acoustical Society of America, Vol. 114, Pages 3317-3326, which are all incorporated by reference in their entirety. The dichotic sounds used in various embodiments include, but are not limited to any of the pitches or sounds provided by these references. The dichotic sounds used in various embodiments of the present subject matter include any dichotically elicited pitch, including binaural edge pitch, binaural coherence edge pitch, Fourcin pitch, and dichotic repetition pitch.

The precise temporal relationships of the noises at the two ears needed for eliciting dichotic pitches necessitates coordinating the two hearing aids. One such system for generating coordinated noises is to use ear-to-ear communication. FIG. 1 shows an example of a block diagram of a system 100 for identifying hearing aid failures using an ear-to-ear coordination of sound generation according to one embodiment of the present subject matter. The digital signal processor (DSP) operating on each hearing aid is capable of communicating with a transceiver on each hearing aid for coordinating playing of the noises. Thus, the right hearing aid (Right HA) and left hearing aid (Left HA) have a DSP and transceiver each, which facilitates ear-to-ear communications. In one embodiment, each hearing aid of the pair of hearing aids has a DSP with code adapted to generate the dichotic pitch. Communications are used to coordinate the start of playing, or transfer parameters associated with the dichotic pitch played. In various embodiments, the parameters include, but are not limited to timing, duration, loudness, fundamental frequency, and harmonic number parameters. In various embodiments, the pair of hearing aids is adapted to receive streaming audio so the dichotic pitch can be received and played by the pair of hearing aids. It is understood that the configuration shown in FIG. 1 is demonstrative and is not intended in an exhaustive or exclusive sense. For example, it is understood that the Right HA and Left HA of FIG. 1 may be used in conjunction with a fitting system (not shown). Other variations are possible without departing from the scope of the present subject matter.

Figure 2:
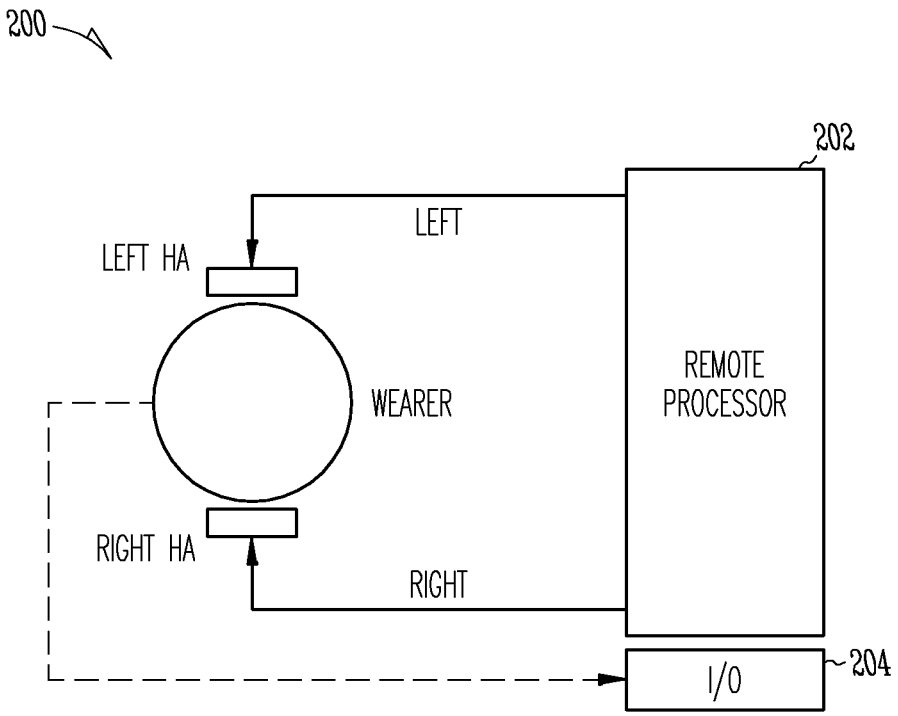
FIG. 2 shows an example of a block diagram of a system for identifying hearing aid failures using a remote processor for coordination of sound generation according to one embodiment of the present subject matter.

One way to coordinate playing of the dichotic pitch is to stream the noise information to the pair of hearing aids from a remote processing unit. FIG. 2 shows an example of a block diagram of a system 200 for identifying hearing aid failures using a remote processor 202 for coordination of sound generation according to one embodiment of the present subject matter. In various embodiments, the connections to the Left HA and the Right HA are wireless. In various embodiments, the connections to the Left HA and the Right HA are wired. It is understood that remote processor 202 may be a standalone unit, or may be the processor of personal computer. In various embodiments, remote processor 202 is the processor of a fitting station. In various embodiments, remote processor 202 is connected to input/output mechanisms, such as I/O 204, which is optional. I/O 204 includes, but is not be limited to, keyboards, screens, mice, touch pads, microphones, and speakers. In various embodiments, the I/O 204 can be used to initiate testing of the hearing aids and can also be used to receive a result from the wearer of the hearing aids. In various embodiments, the remote processor is connected over a network. In one embodiment, the network is the INTERNET. Thus, the control of the testing of the hearing aids can be done remotely and results may be returned to a remote site as well.

Other configurations may exist without departing from the scope of the present subject matter. For example, it is possible that the remote processor may be encoded in hardware, firmware, software, or combinations thereof. It is possible that the system may include a mouse or a keyboard or may include additional input/output devices without departing from the scope of the present subject matter. Other variations are possible without departing from the present subject matter.

Figure 3:
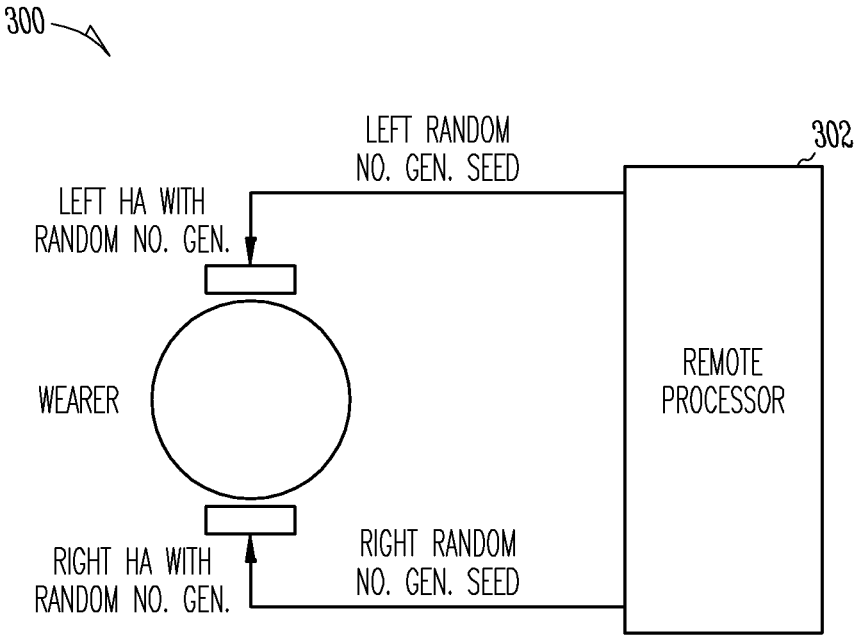
FIG. 3 shows an example of a block diagram of a system for identifying hearing aid failures using a remote processor that provides a random number generator seed for coordination of sound generation according to one embodiment of the present subject matter.

Another method is to incorporate random number generators on both hearing aid DSP units, and seed both with the same information (transmitted from one to the other hearing aid) such that they generate the same sample of noise. FIG. 3 shows an example of a block diagram of a system 300 for identifying hearing aid failures using a remote processor 302 that provides a random number generator seed for coordination of sound generation according to one embodiment of the present subject matter. In this example system 300, the remote processor 302 provides a seed and/or computer executable instructions to the Left HA and the Right HA for random number generation. It is understood that the systems of FIGS. 1 and 4 may also be used to seed both hearing aids with information.

Figure 4:
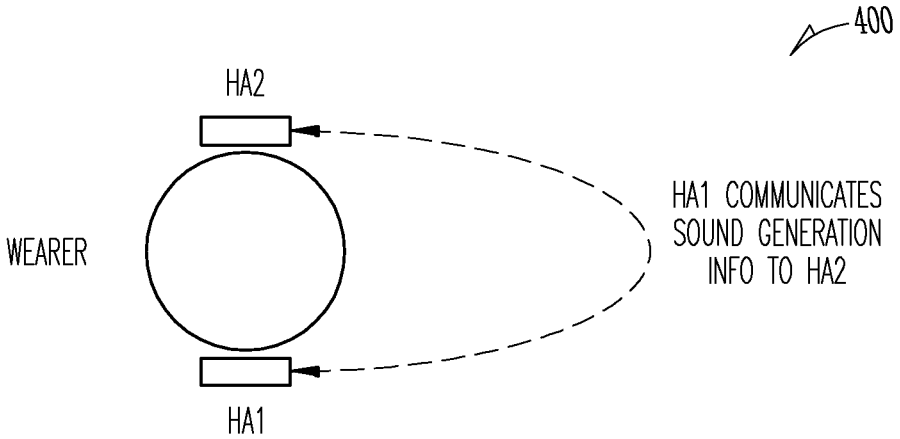
FIG. 4 shows an example of a block diagram of a system for identifying hearing aid failures using one hearing aid providing information to the other for coordination of sound generation according to one embodiment of the present subject matter.

Another method is to generate stimuli for both ears in the DSP unit on one hearing aid and transmit the one meant for the opposite ear to the other hearing aid. FIG. 4 shows an example of a block diagram of a system 400 for identifying hearing aid failures using one hearing aid providing information to the other for coordination of sound generation according to one embodiment of the present subject matter. In this example, the stimuli for both ears is generated on HA1 and transmitted to HA2. In such systems it is possible to use a transmitter on HA1 and a receiver on HA2 or transceivers on both HA1 and HA2. Other variations are possible without departing from the scope of the present subject matter.

Similar principles apply for the use of binaural signal detection and lateralization to monitor dysfunction of the aided binaural system. In both cases, there is a need to meet the constraints imposed by venting and open fittings. There is also the need to meet the constraints imposed by the low fidelity of fine-structure coding by the auditory system above 1600 Hz, although this constraint is less strict in the case of lateralization. Finally, the implementation constraints imposed by the need to set precise temporal relationships between the signals at the two ears are also present if binaural signal detection and lateralization are to be used.

In one example of the case of binaural signal generation and detection, the system produces a left sound and a right sound from noise components and non-noise or "desired" components In various embodiments, the noise signal components are in a homophasic inter-aural phase relation and the desired signal components are in an antiphasic inter-aural phase relation. In various embodiments, the noise signal components are in antiphasic relation and the desired signal components are in homophasic relation. In various embodiments, the inter-aural phase of the noise signal components is different than the inter-aural phase of the desired signal components to enhance the detectability of the desired signal. In various embodiments, the noise signal components and the desired signal components have different inter-aural phase relations at one or more frequencies to enhance the detectability of the desired signal. In various embodiments, the noise signal components have frequency-dependent inter-aural phase that is different at one or more frequencies than the frequency-dependent inter-aural phase of the desired signal components to enhance the detectability of the desired signal. In various embodiments, noise or desired signal approaches with frequency-dependent inter-aural phase are addressed using sub-band approaches. Pure-tone, complex-tone, and tone sequences that form melodies may all be used as the signal. Spoken words, short sentences, and pieces of music may also be used as the signal to be detected. Combinations of these sounds can form the signal to be detected. Thus, when the binaural system of the wearer of the hearing aids is properly functioning, the desired signal will be heard over the noise. In a system without proper binaural function, the noise signal will dominate the desired signal.

In the case of lateralization, the present subject matter can use signals including, but not limited to: a pure tone, a complex tone, tone sequences that form melodies, speech, short sentences, pieces of music, or combinations thereof. Other signals may also be used in various embodiments which satisfy the frequency constraints discussed earlier for the signals used in the dichotic pitch and binaural signal detection. In various embodiments, an additional constraint for lateralization is that the sequence of signals should not occur too rapidly because the brain is sluggish at tracking changes of inter-aural properties of sounds. In the preferred implementation, three signals are presented sequentially, with a spacing of at least 100 ms to 200 ms between the signals. One has an interaural time delay (ITD) of several hundred microseconds favoring one ear, the second has no ITD, and the third has an ITD of several hundred microseconds favoring the other ear. It is understood that varying ITD amounts and numbers of signals can be employed without departing from the scope of the present subject matter. Thus, the ITD can be progressively varied to "pan" the sound across from left to right or right to left for detection by the wearer of the hearing assistance devices. With a dysfunctional aided binaural system, the listener cannot readily detect the change of lateralization between a plurality of stimuli.

Figure 5:
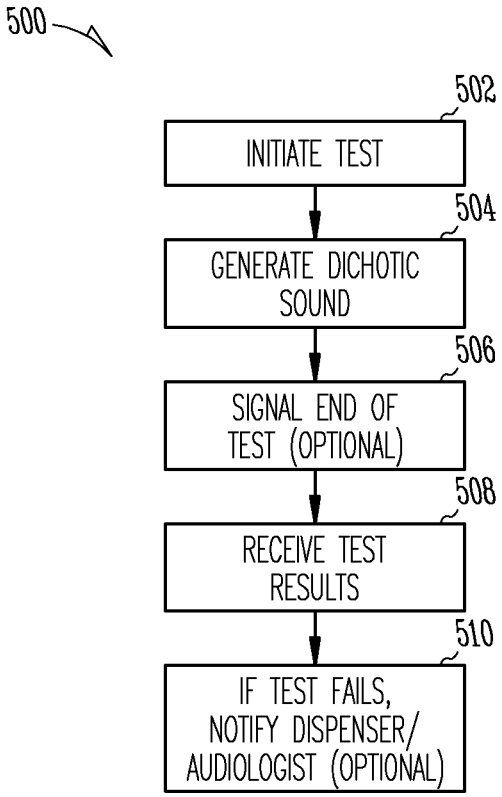
FIG. 5 is a flow diagram for a method of testing according to one embodiment of the present subject matter.

FIG. 5 is a flow diagram for a method of testing 500 according to one embodiment of the present subject matter.

The hearing aids are configured to provide a dichotic sound upon a command at initiation of the testing and to monitor (or detect) the command. After the hearing aids are properly configured, the test can be initiated by a wearer, clinician, or audiologist in various embodiments 502. In various embodiments a tone may be used to signal the beginning of the test (optional and not shown). Upon receipt of the command dichotic sounds are presented to the wearer to determine if the wearer can detect a binaural percept arising from the dichotic sound 504. In various embodiments, an optional tone may be used to signal completion of the test 506. The wearer can communicate the test result to his/her clinician, audiologist, or electronically (for example, directly over the INTERNET to another site or to a fitting system using input/output), in various embodiments. The test result is received 508 and depending on whether the test indicated a pass or fail of the hearing aids, the dispenser and/or audiologist may be notified 510 to begin the next process of correcting the problem with the hearing aids. It is understood that variations of steps and order of steps may be performed without departing from the scope of the present subject matter.

The foregoing example demonstrates a testing process using dichotic sounds. It is understood that the testing process can be performed using different systems providing a wearer with sounds and/or sound environments such that the wearer will experience auditory percepts arising from binaural interaction in the wearer's brain. Such different systems provide sounds and/or sound environments that include, but are not limited to, the phenomena of dichotic pitch, binaural signal detection, and sound lateralization. Thus, the foregoing apparatus and methods are demonstrative and not intended in an exhaustive or exclusive sense.

In examples where a pure tone or complex-tone dichotic pitch (such as a Huggins pitch) is employed, the listener will indicate a positive detection upon detecting a tone or tonal sensation amidst noise. In examples where a dichotic pitch is employed in a temporal sequence to form a melody, the listener will indicate a positive detection upon perception of the tonal melody amidst the noise. In examples where speech or music is employed, the listener will indicate a positive detection upon perception of the speech or music.

In examples where the binaural signal detection advantage is employed, the listener will indicate a positive detection upon detecting a pure tone, a complex tone, a piece of music, or an utterance, whichever is used as a desired signal embedded in noise.

In examples where lateralization is employed, the listener will indicate a positive detection upon detecting a change of position of the different signals as the ITD is varied.

The present subject matter provides several embodiments, including but not limited to a method for testing a pair of hearing aids worn by a wearer, comprising: configuring the hearing aids to play a dichotic sound for testing the binaural operation of the hearing aids upon receipt of a command to start the testing; and programming at least one of the hearing aids to detect the command.

The method further includes configuring the hearing aids to play a dichotic sound eliciting a Huggins pitch, or other dichotically elicited pitches such as, but not limited to, a binaural edge pitch, a binaural coherence edge pitch, a Fourcin pitch, and a dichotic repetition pitch. In various embodiments a pure tone or complex tone can be used. In various embodiments about 900 Hz and about 500 Hz can be employed. In various embodiments the method includes configuring the hearing aids to play a complex-tone pitch as the dichotic sound by simultaneously playing pure-tone pitches at multiple frequencies that are integer multiples of a common fundamental frequency. Various such embodiments may use a common fundamental frequency between 250 to 300 Hz and may include embodiments wherein multiple frequencies are the second, third, fourth, and fifth multiple of the common fundamental frequency.

In various embodiments the process includes selecting the component numbers of a complex tone pitch or the frequency of a pure tone pitch based on a lower frequency limit associated with venting. In various embodiments, the dichotic sound is played as a temporal sequence of pure tone pitches, or the dichotic sound is played as a temporal sequence of complex tone pitches. In various embodiments the dichotic sound is played as a temporal sequence of pitches to form a melody.

The present methods in various embodiments, include recording an indication of whether the dichotic sound was heard by the wearer.

In various embodiments, the dichotic sound is generated from a pair of left and right sounds, wherein the left sound comprises a left noise signal and a left desired signal and the right sound comprises a right noise signal and a right desired signal, and wherein either the right and left noise are antiphasic and the right and left desired signal are homophasic or the right and left desired signal are antiphasic and the right and left noise signal are homophasic. Variations of such approaches include wherein the desired signal is at least one of a pure tone, a complex tone, a sequence of pure or complex tones that form a melody, a piece of music or speech.

In various embodiments, the dichotic sound is generated from a pair of left and right sounds, wherein the left sound comprises a left noise signal and a left desired signal and the right sound comprises a right noise signal and a right desired signal, and wherein the right and left noise are in a different inter-aural phase relation than the inter-aural phase relation of the right and left desired signal so as to enhance detectability of the desired signal. Variations of such approaches include wherein the desired signal is at least one of a pure tone, a complex tone, a sequence of pure or complex tones that form a melody, a piece of music or speech.

In various embodiments, the dichotic sound is generated from a pair of left and right sounds using a variable interaural time difference adapted to provide an ordered progression of lateralization. Such embodiments may include variations wherein the sounds are repeated at intervals to facilitate detection of the ordered progression of lateralization, and may include variations in which the sounds are at least one of a pure tone, a complex tone, a sequence of pure or complex tones that form a melody, a piece of music or speech.

In various embodiments, the present subject matter includes a system for testing a pair of hearing aids, comprising: a pair of hearing aids adapted to play a dichotic sound in time synchronization upon receipt of a command to initiate testing. In various embodiments the system includes a wireless transceiver in each of the pair of hearing aids for coordinating playing of the dichotic sound. In various embodiments, the system includes a wireless transmitter in a first hearing aid of the pair of hearing aids, and a wireless receiver in a second hearing aid of the pair of hearing aids, wherein the first hearing aid is adapted to transmit information to the second hearing aid for coordinating playing of the dichotic sound. In various embodiments, the system includes a wireless receiver in each of the pair of hearing aids, wherein the receiver is adapted to receive signals carrying information for coordinating playing of the dichotic sound. In various embodiments, the system includes a remote processor adapted to provide signals to the pair of hearing aids for coordinating playing of the dichotic sound. In some embodiments, the remote processor is in a fitting station adapted to provide instructions to the pair of hearing aids, wherein the fitting station is adapted to execute instructions for commanding the pair of hearing aids to transmit the dichotic sound. In some embodiments, instructions are stored on at least one of the pair of hearing aids executable by a digital signal processor for playing the dichotic sound. In some embodiments, the dichotic sound includes one or more Huggins pitches or other dichotically elicited pitches such as a binaural edge pitch, a binaural coherence edge pitch, a Fourcin pitch, or a dichotic repetition pitch. In some embodiments, the dichotic sound is generated from a pair of left and right sounds, wherein the left sound comprises a left noise signal and a left desired signal and the right sound comprises a right noise signal and a right desired signal, and wherein the right and left noise are in a different inter-aural phase relation than the inter-aural phase relation of the right and left desired signal so as to enhance detectability of the desired signal. In some embodiments, the dichotic sound is generated from a pair of left and right sounds using a variable interaural time difference adapted to provide an ordered progression of lateralization.

These embodiments are only some of those offered by the present subject matter and thus these embodiments are not exhaustive or exclusive.

The present subject matter is demonstrated in the application of hearing aids, including but not limited to, behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, such as receiver-in-the-ear (RITE) or receiver-in-the-canal (RIC) type devices. The present subject matter can also be used in hearing assistance devices generally, such as cochlear implant type hearing devices. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method for testing a pair of hearing aids worn by a wearer, comprising:

configuring the hearing aids to generate and play a dichotic sound in time synchronization for testing the binaural operation of the hearing aids upon receipt of a command to start the testing, wherein the dichotic sound is repeatedly played to include a progressively variable interaural time difference; and programming at least one of the hearing aids to detect the command, wherein the testing has a predetermined, programmable completion for the wearer to sense and indicate if the binaural operation is detected during a time the dichotic sound is played.

2. The method of claim 1, further comprising configuring the hearing aids to play a dichotic sound eliciting a Huggins pitch.

3. The method of claim 1, further comprising configuring the hearing aids to play a pure tone pitch as the dichotic sound.

4. The method of claim 1, further comprising configuring the hearing aids to play a pure tone pitch at about 900 Hz as the dichotic sound.

5. The method of claim 1, further comprising configuring the hearing aids to play a pure tone pitch at about 500 Hz as the dichotic sound.

6. The method of claim 1, further comprising configuring the hearing aids to play a complex-tone pitch as the dichotic sound by simultaneously playing pure-tone pitches at multiple frequencies that are integer multiples of a common fundamental frequency.

7. The method of claim 6, wherein the common fundamental frequency is between 250 to 300 Hz.

8. The method of claim 7, wherein the multiple frequencies are the second, third, fourth, and fifth multiple of the common fundamental frequency.

9. The method of claim 1, further comprising selecting the component numbers of a complex tone pitch or the frequency of a pure tone pitch based on a lower frequency limit associated with venting.

10. The method of claim 1, wherein the dichotic sound is played as a temporal sequence of pure tone pitches.

11. The method of claim 1, wherein the dichotic sound is played as a temporal sequence of complex tone pitches.

12. The method of claim 1, wherein the dichotic sound is played as a temporal sequence of pitches to form a melody.

13. The method of claim 1, further comprising recording an indication of whether the dichotic sound was heard by the wearer.

14. The method of claim 1, wherein the dichotic sound is generated from a pair of left and right sounds, wherein the left sound comprises a left noise signal and a left desired signal and the right sound comprises a right noise signal and a right desired signal, and wherein either the right and left noise are antiphasic and the right and left desired signal are homophasic or the right and left desired signal are antiphasic and the right and left noise signal are homophasic.

15. The method of claim 14, wherein the desired signal is at least one of a pure tone, a complex tone, a sequence of pure or complex tones that form a melody, a piece of music or speech.

16. The method of claim 1, wherein the dichotic sound is generated from a pair of left and right sounds, wherein the left sound comprises a left noise signal and a left desired signal and the right sound comprises a right noise signal and a right desired signal, and wherein the inter-aural phase relations of the right and left noise differ from the inter-aural phase relations of the right and left desired signal so as to enhance detectability of the desired signal.

17. The method of claim 16, wherein the desired signal is at least one of a pure tone, a complex tone, a sequence of pure or complex tones that form a melody, a piece of music or speech.

18. The method of claim 1, wherein the dichotic sound is generated from a pair of left and right sounds using a variable interaural time difference adapted to provide an ordered progression of lateralization.

19. The method of claim 18, wherein the sounds are repeated at intervals to facilitate detection of the ordered progression of lateralization.

20. The method of claim 19, wherein the sounds are at least one of a pure tone, a complex tone, a sequence of pure or complex tones that form a melody, a piece of music or speech.

21. The method of claim 1, wherein the dichotic sound is played to elicit sounds comprising a Huggins pitch, a binaural edge pitch, a binaural coherence edge pitch, a Fourcin pitch, or a dichotic repetition pitch.

22. A system for testing a pair of hearing aids, comprising:

a pair of hearing aids configured to generate and play a dichotic sound in time synchronization upon receipt of a command to initiate testing of binaural operation of the pair of hearing aids, wherein the dichotic sound is repeatedly played to include a progressively variable interaural time difference, and wherein the initiated testing has a predetermined, programmable completion for the wearer to sense and indicate if the binaural operation is detected during a time the dichotic sound is played.

23. The system of claim 22, further comprising a wireless transceiver in each of the pair of hearing aids for coordinating playing of the dichotic sound.

24. The system of claim 22, further comprising a wireless transmitter in a first hearing aid of the pair of hearing aids, and a wireless receiver in a second hearing aid of the pair of hearing aids, wherein the first hearing aid is adapted to transmit information to the second hearing aid for coordinating playing of the dichotic sound.

25. The system of claim 22, further comprising a wireless receiver in each of the pair of hearing aids, wherein the receiver is adapted to receive signals carrying information for coordinating playing of the dichotic sound.

26. The system of claim 22, further comprising a remote processor adapted to provide signals to the pair of hearing aids for coordinating playing of the dichotic sound.

27. The system of claim 26, wherein the remote processor is in a fitting station adapted to provide instructions to the pair of hearing aids, wherein the fitting station is adapted to execute instructions for commanding the pair of hearing aids to transmit the dichotic sound.

28. The system of claim 27, further comprising instructions stored on at least one of the pair of hearing aids executable by a digital signal processor for playing the dichotic sound.

29. The system of claim 28, wherein the dichotic sound includes one or more Huggins pitches.

30. The system of claim 28, wherein the dichotic sound is played to elicit sounds including a Huggins pitch, a binaural edge pitch, a binaural coherence edge pitch, a Fourcin pitch or a dichotic repetition pitch.

31. The system of claim 28, wherein the dichotic sound is generated from a pair of left and right sounds, wherein the left sound comprises a left noise signal and a left desired signal and the right sound comprises a right noise signal and a right desired signal, and wherein the inter-aural phase relations of the right and left noise differ from the inter-aural phase relations of the right and left desired signal so as to enhance detectability of the desired signal.

32. The system of claim 28, wherein the dichotic sound is generated from a pair of left and right sounds using a variable interaural time difference adapted to provide an ordered progression of lateralization.

* * * * *